US005280142A

United States Patent [19]

Keller

[11] Patent Number: 5,280,142

[45] Date of Patent: Jan. 18, 1994

[54] HEAT SHIELDED EXHAUST SYSTEM COMPONENT

[75] Inventor: Martin T. Keller, Toledo, Ohio

[73] Assignee: AP Parts Manufacturing Company, Ohio

[21] Appl. No.: 778,701

[22] Filed: Oct. 18, 1991

[51] Int. Cl.[5] ..... F01N 5/00

[52] U.S. Cl. ..... 181/211; 181/243; 181/282; 126/83

[58] Field of Search ..... 181/241, 211, 282, 283, 181/243; 126/83; 24/157R, 20CW, 20EE

[56] References Cited

U.S. PATENT DOCUMENTS

| | | | |
|---|---|---|---|
| 2,834,427 | 5/1958 | Powers et al. | 181/241 |
| 3,220,508 | 11/1965 | Norquest et al. | 181/282 |
| 4,430,775 | 2/1984 | Arthur | 24/20 CW |
| 4,456,091 | 6/1984 | Blanchot | 181/282 |
| 4,478,310 | 10/1984 | Harter | 181/241 |
| 4,609,067 | 9/1986 | Gonwa | 181/282 X |
| 4,656,712 | 4/1987 | Harwood et al. | 181/283 X |
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,821,840 | 4/1989 | Harwood et al. | 181/282 |
| 4,836,330 | 6/1989 | Harwood et al. | 181/282 |
| 4,847,965 | 7/1989 | Harwood et al. | 29/157 R |
| 4,860,853 | 8/1989 | Moring, III | 181/282 |
| 4,894,987 | 1/1990 | Harwood et al. | 181/282 X |
| 4,901,815 | 2/1990 | Harwood et al. | 181/282 |
| 4,901,816 | 2/1990 | Garey | 181/282 X |
| 4,905,791 | 3/1990 | Garey | 181/282 |
| 4,909,348 | 3/1990 | Harwood et al. | 181/282 |
| 4,924,968 | 5/1990 | Moring, III et al. | 181/282 |

*Primary Examiner*—Michael L. Gellner
*Assistant Examiner*—Khanh Dang
*Attorney, Agent, or Firm*—Anthony J. Casella; Gerald E. Hespos

[57] ABSTRACT

An exhaust muffler and heat shield assembly and a method for producing the assembly are provided The muffler includes a pair of stamp formed external shells. At least one external shell is stamped to include a plurality of tabs extending outwardly from the peripheral flange of the external shell. The tabs preferably are disposed at locations that otherwise would have defined wastage to be trimmed from the stamp formed external shell The heat shield is configured to be mounted to the muffler by crimping the tabs. In particular, peripheral regions of the heat shield may be engaged between the peripheral flange of the muffler and the crimped tabs. Alternatively, the heat shield may include slots through which the tabs extend for mechanical engagement with the heat shield.

13 Claims, 3 Drawing Sheets

HEAT SHIELDED EXHAUST SYSTEM COMPONENT

BACKGROUND OF THE INVENTION

Exhaust mufflers formed at least in part from stamped components have been available for many years. The typical prior art stamped muffler includes at least a pair of stamp formed external shells. These shells include peripheral flanges dimensioned and configured to be placed generally in register with one another. Portions of each shell intermediate the peripheral flanges are formed to define at least one chamber. The prior art stamp formed muffler further includes one or more internal components between the external shells to define a flow path for exhaust gas through the muffler. In some prior art mufflers, the flow path has been defined by an array of conventional tubes. Examples of mufflers of this general type are shown in U.S. Pat. No. 4,901,816 which issued to David Garey on Feb. 20, 1990 and in U.S. Pat. No. 4,905,791 which issued to David Garey on Mar. 6, 1990. These prior art patents are assigned to the assignee of the subject invention. It will be noted that the external shells of the mufflers shown in U.S. Pat. No. 4,901,816 and in U.S. Pat. No. 4,905,791 include baffles formed from the external shells for supporting the conventional tubes within the muffler. Other prior art mufflers have employed conventional tubes supported by separate transverse baffles and disposed within a stamp formed external shell. A muffler of this general type is shown in published U.K. Patent Application No. 2,120,318A.

Many other prior art mufflers include stamp formed external shells and one or more stamped internal plates formed to define the flow path for exhaust gas through the muffler. An extremely effective muffler of this general type is shown in re-issue Pat. No. Re. 33,370 which was re-issued on Oct. 9, 1990. Re-issue Patent No. Re. 33,370 also is assigned to the assignee of the subject invention. It will be noted that Re. 33,370 shows a muffler with a pair of formed internal plates defining an array of tubes through which exhaust gas in the muffler flows. At least one of the tubes defined by the plates is a tuning tube which communicates with a low frequency resonating chamber. The pair of formed internal plates shown in Re. 33,370 is disposed between the pair of external shells that define the chambers of the muffler.

Other patents assigned to the assignee of the subject invention show still other advances in stamp formed exhaust mufflers. For example, U.S. Pat. No. 4,860,853 which issued to Walter G. Moring, III on Aug. 29, 1989 shows a muffler that can be formed with only three stamped components, but still defining an efficient flow path for exhaust gases and a plurality of chambers for attenuating the noise associated with the flowing exhaust gases. U.S. Pat. No. 4,894,987 issued to Jon Harwood et. al. on Jan. 23, 1990 and covers a stamp formed muffler and catalytic converter assembly.

A vehicular exhaust system generally must travel an extremely circuitous route from one end of the vehicle to the other, and the various components of the exhaust system often must be disposed in closely nested relationship to other parts of the vehicle. Components of the exhaust system, including the muffler, become very hot when the vehicle is operating due to the flow of heated exhaust gas therethrough. In many situations, it is necessary to employ a shield in proximity to the muffler or some other component of the vehicular exhaust system. The shield generally is slightly spaced from the heated exhaust system component and hence provides an insulating layer of air between the shield and the hot exhaust system component. In some situations, the shield is disposed on the side of the muffler or pipe facing away from the vehicle to prevent the heated exhaust system component from igniting dried leaves or grass near the vehicle. Hence, shields mounted on the side away from the vehicle may be referred to as grass shields. In many other situations, the shield is disposed between the muffler or pipe and the vehicle to prevent overheating of floor boards or other parts of the vehicle disposed near the exhaust system component. Shields mounted between the exhaust component and the vehicle generally are referred to as heat shields. The term heat shield will be used herein to refer to any shield regardless of its orientation on the muffler.

The prior art heat shield for an exhaust system component generally has been a flat or slightly curved piece of sheet metal that is strapped to the muffler or pipe. The heat shield may further be formed with stand-offs to achieve the desired spacing from the exhaust system component An extremely effective heat shield of this general type is shown in U.S. Pat. No. 4,478,310 which issued to Donald Harter on Oct. 23, 1984 and which is assigned to the assignee of the subject invention.

Heat shields may be stamp formed efficiently and employed with stamp formed mufflers For example, a heat shielded stamped formed exhaust muffler is shown in U.S. Pat. No. 4,759,423 which issued to Harwood et. al. on Jul. 26, 1988 and which also is assigned to the assignee of the subject invention. The muffler shown in U.S. Pat. No. 4,759,423 employs a pair of stamped internal plates and a pair of stamped external shells to achieve a tri-flow pattern of exhaust gas which in many respects resembles the flow pattern formed with conventional mufflers One embodiment of the muffler shown in U.S. Pat. No. 4,759,423 further employs a heat shield generally conforming to the shape of one of the external shells to nest over the external shell for attachment around the periphery of the muffler. This design provides extremely effective heat shielding. However, the welding or mechanical attachment of five thicknesses of metal around the periphery of the muffler can be difficult. Additionally, the heat shield will not become as hot as the muffler and hence will expand and contract differently. This differential expansion and contraction can damage the welded connection of the heat shield to the muffler. Furthermore, the heat shield often will perform its shielding function if formed from a thinner grade of metal. However, thinner metal is easily damaged by the heat of welding. Thus, it has been necessary to make the heat shield from a thicker metal and thereby incur a cost and weight penalty. As an alternative to the welding or mechanical attachment around the periphery of the muffler, straps could be employed as in the above referenced U.S. Pat. No. 4,478,310. However, straps require additional material, additional weight and an assembly process that is not well suited to automation.

FIGS. 1 and 2 show a prior art stamp formed external shell for an exhaust muffler. The prior art external shell shown in FIGS. 1 and 2 is identified generally by the numeral 10, and is stamped from an initially rectangular flat sheet of metal. A peripheral flange 12 generally will retain its initial planar configuration. However, a central region of the external shell 10 is formed to define at least one chamber 14 The prior art external shell 10 typically will be formed in a progressive stamping die wherein the initially planar rectangular sheet is sequentially worked into the shape of the external shell 10 depicted in FIGS. 1 and 2. As part of this formation process, the metal material of the external shell 10 will deform and stretch to enable the formation of the chamber 14. As shown most clearly in FIG. 2, the external shell 10 will achieve a non-rectangular peripheral configuration due to the stretching and deformation of the metal. In particular, portions of the metal intermediate the corners will be drawn inwardly to enable the formation of the chamber 14. A final step of the progressive stamping operation typically will be to cut the peripheral flange 12 of the external shell 10 into a uniform width as shown by the edge 16 in FIG. 2, which, in this instance is rectangular. Metallic material disposed outwardly from the final edge shape 16 will be accumulated and resold for scrap. However, there is a substantial loss in value in the metal material sold for scrap.

Although the above described stamped mufflers and heat shields are extremely effective, it is desired to provide further efficiencies and improvements in the manufacture of heat shielded mufflers. As a result, it is an object of the subject invention to provide a more efficient heat shield and exhaust muffler combination.

It is another object of the subject invention to provide efficient methods for manufacturing and assembling a heat shielded exhaust muffler.

It is still another object of the subject invention to provide a muffler and heat shield combination with an efficient attachment between the muffler and the heat shield.

Still an additional object of the subject invention is to provide a muffler and heat shield assembly with an efficient means for achieving a desired stand-off therebetween

SUMMARY OF THE INVENTION

The subject invention is directed to a heat shielded exhaust system component, such as a catalytic converter or a muffler or a combined catalytic converter and muffler The converter and/or muffler includes at least one internal component defining a passage for exhaust gas flowing therethrough. The internal components may comprise at least one conventional tube. The internal components may further comprise at least one baffle for supporting the tube and/or for defining more than one chamber within a muffler. In a preferred embodiment as described further below, a muffler is provided with internal flow passages defined by a pair of internal plates that are formed to define an array of tubes within the muffler. The array of tubes comprises at least one inlet to the muffler and at least one outlet from the muffler.

The muffler or converter further comprises at least one external shell that may be stamped or otherwise formed to define at least one chamber surrounding the internal components. The external shell may be defined by a pair of shells formed to define peripheral flanges that are secured to one another to substantially enclose the internal components.

At least one of the components of the muffler or catalytic converter defines at least one heat shield mounting means. For example, at least one external shell of the muffler or converter may be stamped to define a plurality of heat shield mounting tabs. The heat shield mounting tab may extend outwardly from the periphery of a formed component of the muffler or converter. The tab may include a non-planar portion for rigidity, and preferably is formed on a portion of a formed component of the muffler or converter that would otherwise define scrap. For example, one or more tabs may be disposed adjacent corner regions of the formed component which otherwise would have been trimmed to achieve a specified configuration for the muffler or converter.

The assembly of the subject invention further comprises at least one heat shield which may generally conform to the shape of an external shell of the exhaust system component. The heat shield may be formed from a thinner gage metal than the shell of the exhaust system component. The heat shield may be provided with mounting means for engagement with the exhaust system component The mounting means of the heat shield may comprise at least one mounting flange at a peripheral-location on the heat shield for crimped engagement with a peripheral flange of the exhaust system component or for crimped engagement by a mounting tab of the exhaust system component. More particularly, the heat shield may be provided with a plurality of mounting flanges extending from spaced apart locations thereon for engagement by a corresponding plurality of tabs on the exhaust system component. The mounting tabs of the muffler may be crimped or otherwise mechanically deformed to engage the corresponding mounting flanges of the heat shield. Preferably, the heat shield is biased prior to or during mounting to be preloaded against the exhaust system component. The preload prevents relative movement between the heat shield and the exhaust system component and hence avoids rattles during use.

Alternatively, the mounting means on the heat shield may comprise at least one slot on the heat shield through which one or more mounting tabs of the exhaust system component may extend. The mounting tabs of the exhaust system component may be passed through corresponding mounting slots of the heat shield, and may be secured to the heat shield by crimping. In this embodiment, the heat shield may be employed to shield an edge region of the exhaust system component defined by the securely affixed peripheral flanges of the exhaust system component. This latter embodiment is particularly effective in embodiments where a plane defined by the peripheral flanges of the exhaust system component is not horizontally disposed on the vehicle. The heat shield may be dimensioned to achieve a preload against the exhaust system component in this embodiment as well.

The subject invention is further directed to a method of manufacturing a heat shielded component. The method comprises forming at least one component of the muffler or catalytic converter from a sheet of metal. The formed component may define at least one external shell of the muffler or catalytic. The forming is carried out to define a peripheral flange for the formed component of the muffler or catalytic converter. The method further comprises trimming the peripheral flange into a specified peripheral configuration, including the trimming of at least one heat shield mounting tab on the formed component of the muffler or catalytic converter. The method further may comprise the step of forming the heat shield mounting tab into a selected non-planar configuration to ensure rigidity. The heat shield may then be mounted to the muffler or catalytic converter by crimping the mounting tabs. Preferably, the heat shield is biased and deformed during mounting to achieve a preload against the muffler or catalytic converter.

The non-welded connection of the heat shield to the muffler or catalytic converter in accordance with the subjection invention achieves several significant advantages. First, the problems that could be encountered in attempting to weld through several thicknesses of metal are entirely avoided Second, a thinner gage metal and a less expensive metal that might not be weldable to the muffler or catalytic converter can be used on the heat shield. Third, the preload of the heat shield against the muffler or catalytic converter entirely avoids the relative movement of components that exists with prior art mechanical engagement means for heat shields.

DETAILED DESCRIPTION OF THE PREFERRED EMBODIMENT

Figure 3:
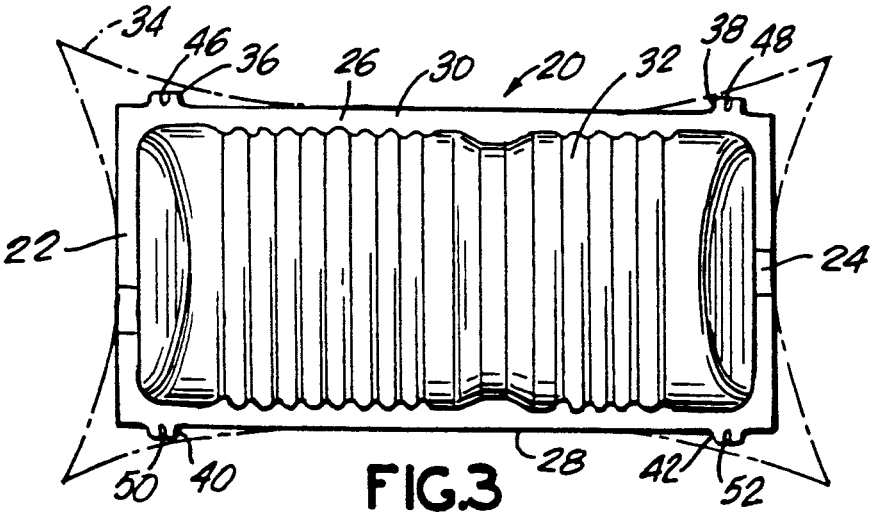
FIG. 3 is a top plan view of an external shell of a muffler in accordance with the subject invention.

An external shell for a muffler in accordance with the subject invention is identified generally by the numeral 20 in FIG. 3. The external shell 20 preferably is formed from an initially planar sheet of metal in a transfer stamping apparatus. However, other metal forming techniques may be employed In its final formed configuration, the external shell 20 is of generally rectangular configuration with opposed longitudinal ends 22 and 24 and opposed sides 26 and 28. The external shell 20 includes a substantially planar peripheral flange 30 from which a chamber 32 extends. The chamber 32 is formed with an array of substantially parallel reinforcing grooves which may be similar to those disclosed in U.S. Pat. No. 4,924,968 which issued to Moring et. al. on May 15, 1990 and which is assigned to the assignee of the subject invention. The formation of the chamber 32 causes a stretching and drawing of the initially rectangular planar sheet of metal from which the external shell 20 is formed. In particular, the shape of the metal from which the external shell 20 is formed prior to final trimming is shown in phantom lines in FIG. 3 and is identified generally by the numeral 34. It will be noted that the sheet of metal 34 prior to trimming defines greater lengths and widths in proximity to the corners of the external shell 20.

Figure 1:
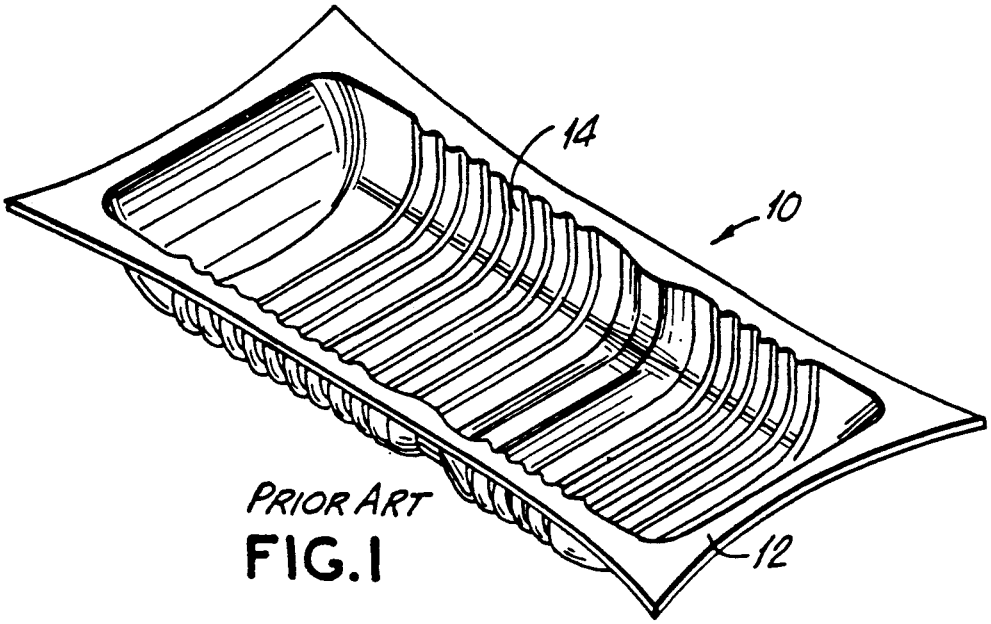
PRIOR ART FIG.1
FIG. 1 is a perspective view of a prior art stamp formed external shell for a muffler prior to final trimming of the peripheral flange.
Figure 2:
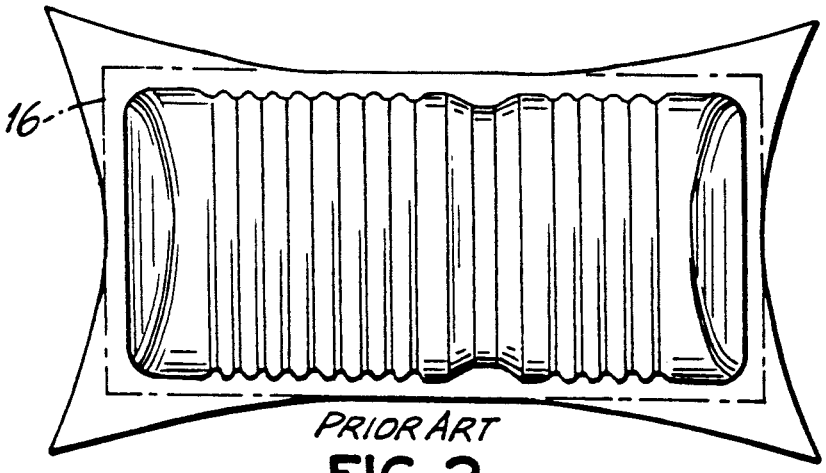
PRIOR ART FIG.2
FIG. 2 is a top plan view of the prior art external shell shown in FIG. 1.

In contrast to the prior art external shell shown in FIG. 2, the external shell 20 of the subject invention is trimmed to include heat shield mounting tabs 36–42. In particular, tabs 36 and 38 extend from the first longitudinal side 26 in proximity to the first and second ends 22 and 24 respectively. Similarly, the tabs 40 and 42 extend from the second longitudinal side 28 in proximity to the first and second longitudinal ends 22 and 24 respectively. The tabs 36–42 are characterized by corrugations 46–52 respectively. The corrugations 46–52 are provided to make the tabs 36–42 rigid.

Figure 4:
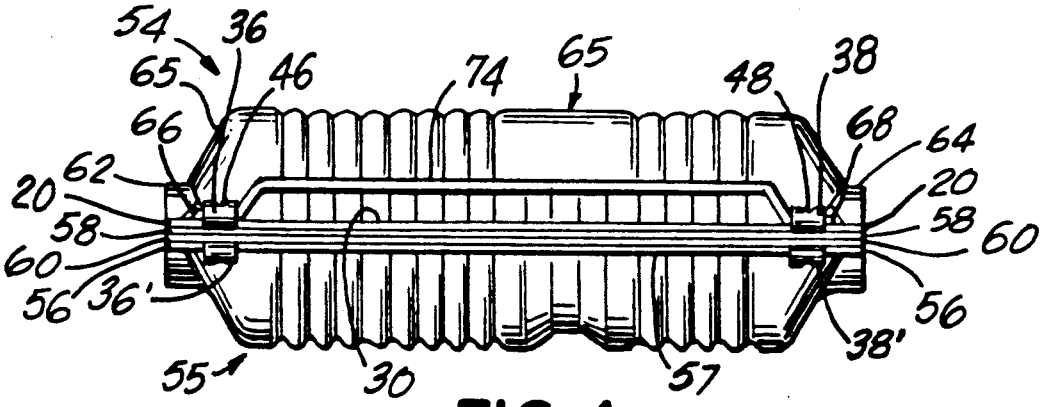
FIG. 4 is a side elevational view of a muffler and heat shield assembly in accordance with the subject invention.
Figure 5:
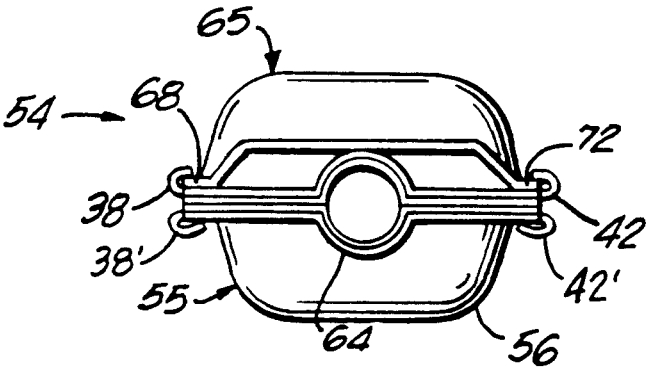
FIG. 5 is an end elevational view of the muffler and heat shield assembly shown in FIG. 4.
Figure 6:
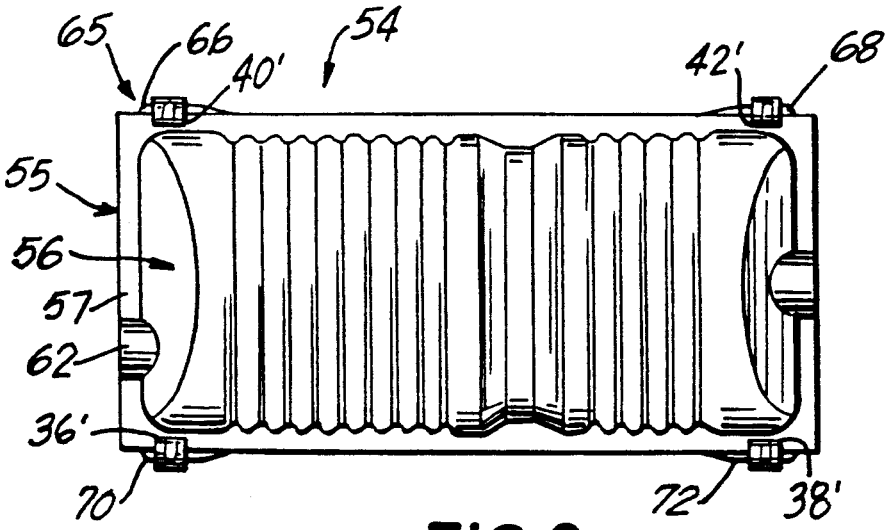
FIG. 6 is a bottom plan view of the muffler and heat shield assembly shown in FIGS. 4 and 5.

The external shell 20 defines a portion of a muffler/-heat shield assembly identified generally by the numeral 54 in FIGS. 4– 6. The assembly 54 includes a muffler 55 having a first external shell 20, as described and illustrated above, and an opposed second external shell 56 which is depicted as being substantially identical to the first external shell 20. However, such identity is not required, and the actual shape of the second external shell 56 will be determined, in part, by the acoustical requirements of the muffler and the available space on the underside of the vehicle. The muffler 55 further includes at least one internal component defining a flow passage for exhaust gas. In the embodiment depicted in FIGS. 4–6, the flow passage is defined by first and second stamp formed internal plates 58 and 60 respectively. The internal plates 58 and 60 preferably are stamped with arrays of opposed channels defining tubes therebetween through which exhaust gas may flow. The arrays of tubes may be structurally and functionally similar to those described in the above referenced patents that are assigned to the assignee of the subject invention. However, in other embodiments the flow passage may be defined by an array of conventional tubes and associated baffles. The internal plates 58 and 60 and the external shells 20 and 56 are further stamped to define at least one inlet 62 to the muffler 55 and at least one outlet 64. The inlet 62 and outlet 64 will be connected respectively to the exhaust pipe and tail pipe (not shown) on a vehicle.

The muffler/heat shield assembly 54 further includes a stamp formed heat shield identified generally by the numeral 65 in FIGS. 4–6. The heat shield 65 generally conforms to the shape of the first external shell 20. The heat shield 65 is stamped to include mounting flanges 66–72 respectively. The mounting flanges 66–72 are disposed and dimensioned to be placed generally in register with and to mount approximately adjacent to the peripheral flange 30 of the first external shell 20. However, the heat shield 65 preferably is dimensioned to require a slight biasing of opposed longitudinal sides to achieve perfect registration and alignment. The heat shield 65 may be secured in the biased or preloaded position shown in FIGS. 4–6 by crimping the respective mounting tabs 36–42 of the first external shell 20 into secure engagement with the respective mounting flanges on the heat shield 65. This crimped mounting of the heat shield 65 permits differential thermal expansion and avoids the above described problems with welding. The biasing or preload prevents vibration related movement between the heat shield 65 and the first external shell 20 The heat shield 65 is held by the tabs 36–42 in spaced relationship to the first external shell 20 to achieve an insulating air space therebetween as shown most clearly in FIGS. 4 and 5. The spacing between the heat shield 65 and the first external shell 20 is determined by the geometry of the mounting flanges 66–72 of the heat shield 65.

The heat shield 65 includes a peripheral flange 74 extending intermediate the mounting flanges 66–72. The peripheral flange 74 is disposed and configured to be substantially spaced from the peripheral flange 30 of the first external shell 20. The spacing between the peripheral flange 74 of the heat shield 65 and the peripheral flange 30 of the first external shell 20 facilitates a flow of air between the first external shell 20 and the heat shield 65. This flow of air enhances the cooling and insulating function carried out by the heat shield 65.

As shown in FIGS. 4–6, the heat shield 65 is disposed to be positioned between the muffler 55 and the vehicle to which the muffler 55 is attached. In other embodiments, however, it may be preferable to have the heat shield 65 positioned intermediate the muffler 55 and the surface on which the vehicle is supported, and to function as a grass shield. This can readily be achieved by providing the second external shell 56 with heat shield mounting tabs 36'–42' comparable to the tabs 36–42 on the first external shell 20. Thus, the muffler 55 could be provided with a top heat shield 65 and/or a substantially similar opposed bottom heat shield or grass shield (not shown) mounted to tabs 36'–42' extending from the second external shell 56. The tabs 36–42 or 36'–42' normally would be wastage or offage, as noted above. Consequently, tabs 36–42 and 36'–42' may always be provided on both external shells 20 and 56 at all times. The tabs 36'–42' may always be crimped ove even in situations where a heat shield is not present.

Figure 7:
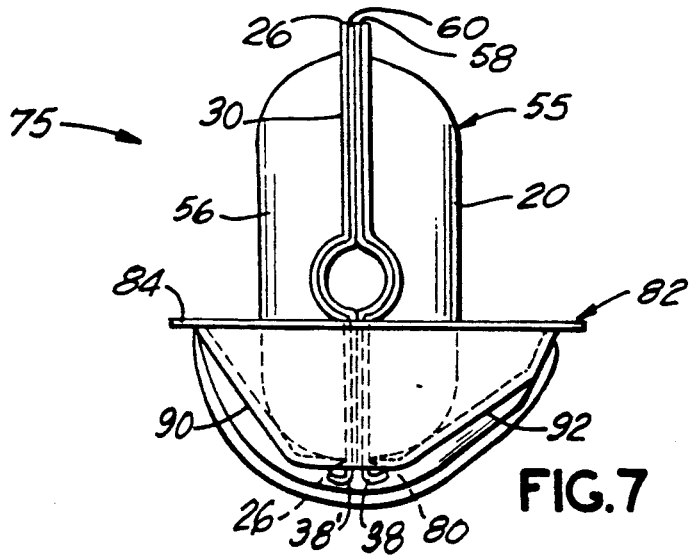
FIG. 7 is an end elevational view of an alternate muffler and heat shield combination in accordance with the subject invention.
Figure 8:
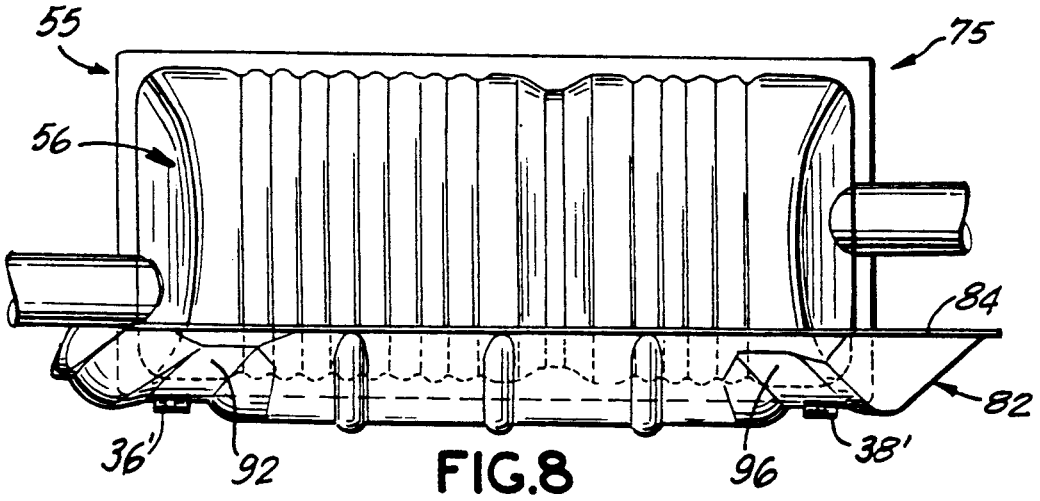
FIG. 8 is a side elevational view of the muffler and heat shield assembly shown in FIG. 7.
Figure 9:
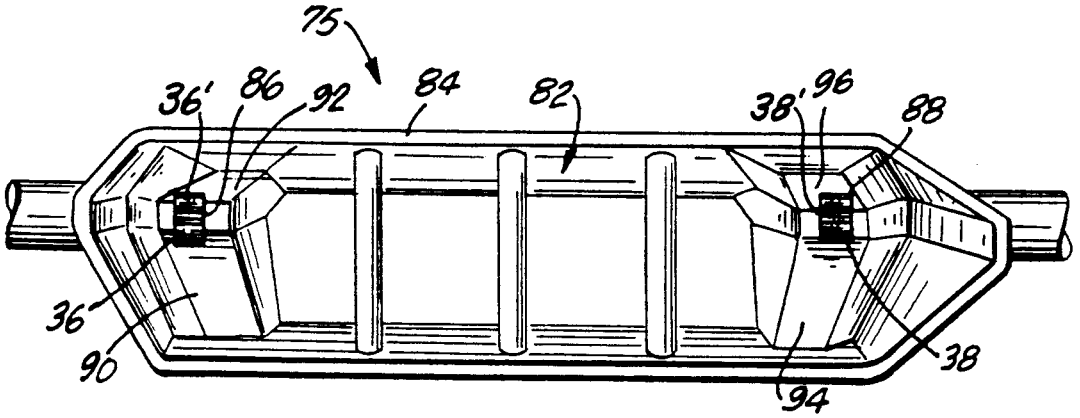
FIG. 9 is a bottom plan view of the muffler and heat shield assembly shown in FIGS. 7 and 8.

An alternate muffler and heat shield assembly is shown in FIGS. 7–9 and is identified generally by the numeral 75. The assembly 75 includes a muffler 55 which is substantially identical to the muffler 55 described above and illustrated in FIGS. 4–6. In particular, the muffler 55 shown in FIGS. 4 6 includes first and second external shells 20 and 56 respectively and first and second internal plates 58 and 60. However, the available space on the underside of the vehicle with which the muffler 55 is used requires the peripheral flanges of the first and second external shells 20 and 56 and the planes defined by the first and second internal plates 58 and 60 to be orientated substantially vertically with respect to the surface on which the vehicle is supported.

The assembly 75 further includes a heat shield 82 disposed to be positioned between the muffler 55 and the surface on which the vehicle is supported. The heat shield 82 is intended to prevent inadvertent contact with the heated muffler 55 and further to prevent the heated muffler 55 from contacting any combustible material that may be disposed on the ground. The heat shield 82 is of elongated configuration generally conforming to the profile of the muffler 55. In particular, the heat shield 82 includes a peripheral flange 84 disposed and dimensioned to be in spaced relationship to the muffler 55. The heat shield 82 is further characterized by a pair of aligned slots 86 and 88 respectively disposed and dimensioned to receive the tabs 36, 38, 36' and 38' of the muffler 55. More particularly, the tabs 36 and 36' of the muffler 55 are disposed and dimensioned to pass through the slot 86 in the heat shield 82. Similarly, the slot 88 is disposed and dimensioned to receive the tabs 38 and 38' of the muffler 55. The tabs 36, 38, 36' and 38' may be folded over to securely engage the heat shield 82 and thereby mechanically ret in the heat shield to the muffler 55.

The heat shield 82 is further characterized by lateral support surfaces 90 and 92 extending from opposite sides of the slot 86 and toward the peripheral flange 84. Similarly, lateral support surfaces 94 and 96 extend from the slot B8 toward the peripheral flange 84. The lateral support surfaces 90–96 are configured to be preloaded against and supportingly engage the respective external shells 20 and 56 on the muffler 55. In particular, the mechanical engagement of the tabs 36, 38, 36' and 38' with the heat shield 82 preloads the lateral support surfaces 90–96 of the heat shield 82 firmly against the external shells 20 and 56 of the muffler 55, thereby preventing rattling and avoiding the need to manually affix straps around the muffler and heat shield assembly 75.

While the invention has been described with respect to certain preferred embodiments, it is apparent that various changes can be made without departing from the scope of the invention as defined by the appended claims. In particular, the respective mufflers and heat shields may assume configurations other than the rectangular shapes depicted in the attached figures. Additionally, more then one heat shield may be employed with each muffler. Furthermore, the relative position of the heat shield to the muffler is not restricted to any particular gravitational orientation, but rather is dictated by design and safety considerations for the exhaust system and the associated vehicle.

We claim:

1. An exhaust system component and heat shield assembly comprising:

an exhaust system component including first and second external shells formed from sheet material and defining peripheral flanges securely engaged to one another and at least one chamber intermediate the peripheral flanges, at least one inlet and at least one outlet providing communication with the chamber, the exhaust system component being substantially rectangular and being characterized by four corners, at least one of the external shells being unitarily formed with four spaced-apart mounting tabs extending outwardly from the peripheral flanges and disposed respectively in proximity to the four corners of the exhaust system component; at least one heat shield having a shielding portion disposed in spaced relationship to the exhaust system component and a plurality of mounting portions mounted to the exhaust system component; the mounting tabs of the exhaust system component being crimped to securely engage the mounting portions of the heat shield, whereby disposition of the mounting tabs in the corners achieves efficient utilization of the formed sheet material from which the respective external shells if formed.

2. An assembly as in claim 1, wherein the tabs include non-planar portions configured for providing selected rigidity to the heat shield.

3. An assembly as in claim 1, wherein the heat shield is retained in a deformed preloaded condition by the crimped mounting tabs to prevent relative movement between the heat shield and the exhaust system component.

4. An assembly as in claim I, wherein portions of the heat shield intermediate the tabs of the exhaust system component extend concavely away from the exhaust system component to enhance air flow between the exhaust system component and the heat shield.

5. An exhaust system component and heat shield assembly comprising: an exhaust system component including first and second external shells formed to define peripheral flanges securely engaged to one another and formed to define at least one chamber intermediate the peripheral flanges, at least one inlet and at least one outlet providing communication with the chamber, a plurality of mounting tabs extending unitarily from a selected portion of said exhaust system component; at least one heat shield having a shielding portion disposed in spaced relationship to the exhaust system component and a plurality of mounting portions mounted to the exhaust system component, the mounting portions of the heat shield being characterized by at least one slot for receiving the tabs of the exhaust system component, the tabs being crimped and mechanically engaged to portions of the heat shield adjacent the slot therein to securely engage the heat shield to the exhaust system component.

6. An assembly as in claim 5, wherein the mounting portion of the heat shield further includes a plurality of supporting surfaces in proximity to the slot, the supporting surfaces being disposed and dimensioned to supportingly engage portions of the exhaust system component in proximity to the tabs for preventing relative movement between the heat shield and the exhaust system component.

7. An assembly as in claim 6, wherein the peripheral flanges of the first and second external shells each are characterized by substantially registered first side edges, the tabs of the exhaust system component comprising a pair of tabs projecting from the first side edge of the peripheral flange of the first external shell and a pair of tabs projecting from the first side edge of the peripheral flange of the second external shell, the tabs of the first external shell being substantially registered with the tabs of the second external shell, the heat shield comprising a pair of slots, with each slot being disposed and dimensioned to receive a tab from each said external shell of the exhaust system component.

8. A muffler and heat shield assembly, the muffler of the assembly comprising a plurality of formed components including a pair of internal plates secured in face to face relationship with one another and formed to define an array of tubes therebetween, the array of tubes including at least one inlet to the muffler and at least one outlet from the muffler, a pair of external shells each being formed to include a peripheral flange and at least one chamber extending from the peripheral flanges, the peripheral flanges being secured around the internal plates such that the chambers substantially enclose at least portions of the tubes defined by the internal plates, at least one of said formed components including a longitudinal side having a plurality of tabs projecting away from the peripheral flanges; the heat shield of the assembly being formed to define at least one slot therein for receiving the tabs of the muffler, the tabs being securely engaged to the heat shield adjacent the slot therein for mounting the heat shield to the muffler.

9. An assembly as in claim 8, wherein the heat shield includes a plurality of support surfaces in proximity to said slot, the support surfaces being dimensioned and disposed to contact the muffler for preventing relative movement between the heat shield and the muffler.

10. An assembly as in claim 9, wherein the tabs of the muffler are crimped into mechanical engagement with the heat shield.

11. An assembly as in claim 10, wherein the heat shield is retained in a deformed preloaded condition by the tabs to prevent relative movement between the heat shield and the muffler.

12. An assembly as in claim 3, wherein the heat shield is deformed into the preloaded condition by urging the mounting portions of the heat shield from an initial unbiased position into a preloaded position, and crimping the tabs to the mounting portions in their preloaded condition to retain the heat shield in the preloaded condition on the exhaust system component.

13. An assembly as in claim 1, wherein the external shells are formed from a sheet metal of a selected thickness, and wherein the heat shield is formed from a sheet metal defining a thickness less than the thickness of the external shells.

* * * * *